US010987790B2

(12) United States Patent
Garber

(10) Patent No.: US 10,987,790 B2
(45) Date of Patent: Apr. 27, 2021

(54) CORDLESS CONCRETE NAILER WITH IMPROVED POWER TAKE-OFF MECHANISM

(71) Applicant: Black & Decker Inc., New Britain, CT (US)

(72) Inventor: Stuart E. Garber, Towson, MD (US)

(73) Assignee: Black & Decker Inc., New Britain, CT (US)

( * ) Notice: Subject to any disclaimer, the term of this patent is extended or adjusted under 35 U.S.C. 154(b) by 290 days.

(21) Appl. No.: 15/630,273

(22) Filed: Jun. 22, 2017

(65) Prior Publication Data

US 2018/0001456 A1 Jan. 4, 2018

Related U.S. Application Data

(60) Provisional application No. 62/357,515, filed on Jul. 1, 2016, provisional application No. 62/356,966, filed on Jun. 30, 2016.

(51) Int. Cl.
*B25C 1/00* (2006.01)
*B25C 1/06* (2006.01)

(52) U.S. Cl.
CPC ..... *B25C 1/06* (2013.01); *B25C 1/008* (2013.01)

(58) Field of Classification Search
CPC .. B25C 1/00; B25C 1/008; B25C 1/06; B25C 5/00; B25C 5/06; B25C 5/10
(Continued)

(56) References Cited

U.S. PATENT DOCUMENTS 1,526,025 A 2/1925 Street
2,594,605 A 4/1952 Zoppelt
(Continued)

FOREIGN PATENT DOCUMENTS

DE 29917830 U1 2/2000
EP 218778 A1 4/1987
(Continued)

OTHER PUBLICATIONS

International Search Report and Written Opinion dated Nov. 2, 2017 in corresponding International Patent Application No. PCT/US2017/039988.

(Continued)

*Primary Examiner* — Thanh K Truong
*Assistant Examiner* — David G Shutty
(74) *Attorney, Agent, or Firm* — Harness, Dickey & Pierce, P.L.C.

(57) ABSTRACT

A power take-off (PTO) assembly of a cordless electric concrete driver includes a bracket supporting a solenoid and a compression spring and a linkage arm coupled between a plunger of the solenoid and the compression spring. The linkage arm is biased by the compression spring toward the nail driver. A carrier supports or carries a pinch roller and the carrier is pivotably mounted to the bracket via a pivot pin. An engaging surface is movable with the plunger between an engagement position in which the engaging surface engages a cooperating engaging surface of the carrier and orients the carrier into a corresponding engagement orientation, and a disengagement position in which the engaging surface is spaced away from the cooperating engaging surface of the carrier, allowing the carrier to pivot outside the corresponding engagement orientation.

20 Claims, 6 Drawing Sheets

(58) Field of Classification Search
USPC ..... 227/131
See application file for complete search history.

(56) References Cited

U.S. PATENT DOCUMENTS 2,745,689 A 5/1956 Balint
2,822,698 A 2/1958 Gross
2,979,725 A 4/1961 Wandel et al.
3,172,124 A 3/1965 Kremiller
3,225,443 A 12/1965 Young
3,480,210 A 11/1969 Perrinjaquet
3,563,438 A 2/1971 Doyle et al.
3,570,739 A 3/1971 Volkmann et al.
3,603,281 A 9/1971 Froelich
3,658,229 A 4/1972 Pomeroy
3,659,768 A 5/1972 Brunelle
3,743,159 A 7/1973 Schneider
3,765,588 A 10/1973 Frederickson
3,768,846 A 10/1973 Hensley et al.
3,774,293 A 11/1973 Golsch
3,820,705 A 6/1974 Beals
3,827,822 A 8/1974 Converse
3,890,058 A 6/1975 Self et al.
3,893,610 A 7/1975 Smith
3,979,040 A 9/1976 Denin
4,033,499 A 7/1977 Butler
4,049,181 A 9/1977 Kametaki
4,129,240 A 12/1978 Geist
4,186,862 A 2/1980 Klaus
4,197,974 A 4/1980 Morton et al.
4,230,249 A 10/1980 Nasiatka et al.
4,270,587 A 6/1981 Ludy
4,270,687 A 6/1981 Maurer
4,304,349 A 12/1981 Novak et al.
4,313,552 A 2/1982 Maurer
4,314,782 A 2/1982 Beekenkamp
4,316,513 A 2/1982 Harris
4,389,012 A 6/1983 Grikis et al.
4,403,725 A 9/1983 Lawrence
4,404,894 A 9/1983 Oesterle
4,416,172 A 11/1983 Medinger
4,424,929 A 1/1984 Weis
4,468,159 A 8/1984 Oster
4,485,952 A 12/1984 Weis
4,487,355 A 12/1984 Ginnow et al.
4,519,535 A 5/1985 Crutcher
4,558,811 A 12/1985 Klaus
4,566,621 A 1/1986 Becht
4,597,517 A 7/1986 Wagdy
4,667,747 A 5/1987 Falls et al.
4,765,786 A 8/1988 Krogh
4,807,793 A 2/1989 Ghibely
4,834,342 A 5/1989 Padgett
4,854,393 A 8/1989 Palet
4,863,089 A 9/1989 McCardle et al.
4,912,848 A 4/1990 Bidanset
4,967,623 A 11/1990 Jackson
5,025,968 A 6/1991 Nasiatka
5,074,453 A 12/1991 Tachihara et al.
5,134,812 A 8/1992 Hoffman et al.
5,165,827 A 11/1992 Miller
5,192,012 A 3/1993 Schafer et al.
5,261,588 A 11/1993 Lin
5,297,886 A 3/1994 Jansen et al.
5,368,213 A 11/1994 Massari, Jr.
5,405,071 A 4/1995 Baugus
5,462,127 A 10/1995 Svensson
5,478,002 A 12/1995 Clement et al.
5,484,094 A 1/1996 Gupta
5,495,973 A 3/1996 Ishizawa et al.
5,575,051 A 11/1996 Moore
5,588,577 A 12/1996 Chen
5,647,525 A 7/1997 Ishizawa
5,649,661 A 7/1997 Masuno et al.
5,683,024 A 11/1997 Eminger et al.
5,695,108 A 12/1997 Lee
5,711,471 A 1/1998 White
5,779,145 A 7/1998 Zelle et al.
5,782,395 A 7/1998 Sauer
5,813,588 A 9/1998 Lin
5,816,468 A 10/1998 Yang
5,831,817 A 11/1998 Chang
5,921,562 A 7/1999 Robison
5,931,364 A 8/1999 Dennis
6,036,072 A 3/2000 Lee et al.
6,053,389 A 4/2000 Chu et al.
6,056,181 A 5/2000 Chuang et al.
6,112,831 A 9/2000 Gustafsson
6,131,787 A 10/2000 Curtis
6,145,723 A 11/2000 Gupta
6,149,046 A 11/2000 Ho et al.
6,161,744 A 12/2000 Mukoyama et al.
6,199,739 B1 3/2001 Mukoyama et al.
6,308,879 B1 10/2001 Wang
6,364,192 B1 4/2002 Lin
6,371,348 B1 4/2002 Canlas et al.
6,394,332 B2 5/2002 Akiba
6,431,428 B1 8/2002 Chen
6,557,743 B2 5/2003 Schuster
6,585,142 B1 7/2003 Chen
6,598,775 B1 7/2003 Chen
6,598,777 B2 7/2003 Osuga et al.
6,641,018 B2 11/2003 Akiba
6,672,497 B2 1/2004 Lin
6,691,907 B1 2/2004 Chang
6,769,591 B2 8/2004 Yamamoto et al.
6,789,718 B2 9/2004 Canlas et al.
6,796,475 B2 9/2004 Adams
6,805,272 B1 10/2004 Sen-Mu et al.
D498,127 S 11/2004 Leasure
6,814,156 B2 11/2004 Dieterle et al.
6,908,021 B1 6/2005 Wang
6,913,180 B2 7/2005 Schuster
6,918,527 B2 7/2005 Hakozaki et al.
D509,418 S 9/2005 Leasure
6,948,647 B1 9/2005 Niblett et al.
6,966,477 B1 11/2005 Chien-Kuo et al.
6,971,567 B1 * 12/2005 Cannaliato ..... B25C 1/06 173/1
6,974,061 B2 12/2005 Adams et al.
6,974,062 B2 12/2005 Akiba
6,978,920 B2 12/2005 Hamada et al.
7,000,294 B2 2/2006 Kakuda et al.
D520,839 S 5/2006 Miwa
7,055,728 B2 6/2006 Lin
7,086,573 B1 8/2006 Wen
7,100,475 B1 9/2006 Rufolo, Jr.
7,134,586 B2 11/2006 McGee et al.
7,137,541 B2 11/2006 Baskar et al.
7,138,595 B2 11/2006 Berry et al.
7,140,524 B2 11/2006 Hung et al.
7,143,921 B2 12/2006 Hakozaki et al.
7,165,305 B2 1/2007 Kenney et al.
7,204,403 B2 4/2007 Kenney et al.
7,210,607 B2 5/2007 Niblett et al.
D551,931 S 10/2007 Leasure
7,285,877 B2 10/2007 Gorti et al.
D556,003 S 11/2007 Buck
7,303,103 B2 12/2007 Wang
7,322,506 B2 1/2008 Forster
D562,664 S 2/2008 Buck
7,328,826 B2 2/2008 Shkolnikov
7,331,403 B2 2/2008 Berry et al.
7,410,084 B1 8/2008 Reed
7,413,103 B1 8/2008 Ho et al.
7,451,735 B2 11/2008 Riley et al.
7,469,811 B2 12/2008 Shima et al.
7,470,081 B2 12/2008 Miyahara et al.
7,484,647 B2 2/2009 Yang
7,494,036 B2 2/2009 Shima et al.
7,497,058 B2 3/2009 Martensson
7,503,401 B2 3/2009 Gross et al.
7,506,787 B2 3/2009 Wu et al.
7,513,402 B2 4/2009 Miyashita et al.

(56) References Cited

U.S. PATENT DOCUMENTS 7,516,532 B2 4/2009 Wojcicki
7,552,852 B2 6/2009 Haskins et al.
7,556,184 B2 7/2009 Brendel et al.
7,559,447 B2 7/2009 Chen et al.
7,565,992 B2 7/2009 Buetow
7,571,844 B2 8/2009 Bromley et al.
7,575,140 B2 8/2009 Jiang
7,575,141 B1 8/2009 Liang et al.
7,575,142 B2 8/2009 Liang et al.
7,600,662 B2 10/2009 Nayrac et al.
7,637,408 B2 12/2009 Takahashi et al.
7,646,157 B2 1/2010 Cruise et al.
7,654,430 B2 2/2010 Cho et al.
7,686,199 B2 3/2010 Gross et al.
7,690,546 B2 4/2010 Cortez
7,708,505 B2 5/2010 Opsitos, Jr. et al.
7,726,536 B2 6/2010 Gross et al.
7,748,588 B2 7/2010 Osuga et al.
7,753,243 B2 7/2010 Brendel et al.
7,762,443 B2 7/2010 Tamura et al.
7,784,238 B2 8/2010 Bannister
7,788,997 B2 9/2010 Kozak et al.
7,789,169 B2 9/2010 Berry et al.
7,870,987 B1 1/2011 Zhang et al.
7,874,469 B2 1/2011 Liu
7,905,377 B2 3/2011 Krondorfer et al.
7,930,960 B2 4/2011 Duginske
7,934,565 B2 5/2011 Krondorfer et al.
7,934,566 B2 5/2011 Hlinka et al.
7,959,049 B2 6/2011 Dittrich et al.
7,975,893 B2 7/2011 Berry et al.
7,980,439 B2 7/2011 Akiba et al.
7,980,441 B2 7/2011 Dittrich et al.
7,997,467 B2 * 8/2011 Hirabayashi ..... B25C 1/06 227/131
8,011,441 B2 9/2011 Leimbach et al.
8,011,547 B2 9/2011 Leimbach et al.
8,011,549 B2 9/2011 Berry et al.
8,025,197 B2 9/2011 Brendel et al.
8,042,717 B2 10/2011 Lam et al.
RE42,987 E 12/2011 Akiba
8,091,752 B2 1/2012 Jian et al.
8,104,658 B2 1/2012 Yu
8,123,099 B2 2/2012 Kenney et al.
8,136,606 B2 3/2012 Krondorfer et al.
8,167,182 B2 5/2012 Shima et al.
8,172,814 B2 5/2012 Cane'
8,230,941 B2 7/2012 Leimbach et al.
8,231,039 B2 7/2012 Buck et al.
8,240,534 B2 * 8/2012 Hirabayashi ..... B25C 1/06 227/131
8,256,528 B2 9/2012 Oesterle et al.
8,267,296 B2 9/2012 Leimbach et al.
8,267,297 B2 9/2012 Leimbach et al.
8,286,722 B2 10/2012 Leimbach et al.
8,292,143 B2 10/2012 Lee et al.
8,302,833 B2 11/2012 Gross et al.
8,313,012 B2 11/2012 Shima et al.
8,347,978 B2 1/2013 Forster et al.
8,381,830 B2 2/2013 Puzio et al.
8,387,718 B2 3/2013 Leimbach et al.
8,387,846 B2 3/2013 Francis et al.
8,408,327 B2 4/2013 Forster et al.
8,434,566 B2 5/2013 Forster et al.
8,439,242 B2 5/2013 Tanji et al.
8,505,798 B2 8/2013 Simonelli et al.
8,534,527 B2 9/2013 Brendel et al.
8,602,282 B2 12/2013 Leimbach et al.
8,631,986 B2 1/2014 Hlinka et al.
8,684,246 B2 4/2014 Liang et al.
8,763,874 B2 7/2014 McCardle et al.
8,777,081 B2 7/2014 Chen et al.
8,827,132 B2 9/2014 Mina et al.
8,925,233 B2 1/2015 Thordsen
8,991,675 B2 3/2015 Liang et al.
8,997,744 B2 4/2015 Ho et al.
9,010,493 B2 4/2015 Jagdale et al.
9,038,305 B2 5/2015 Volfson
9,120,028 B2 9/2015 Wilson
9,126,319 B2 9/2015 Gross et al.
9,194,637 B2 11/2015 Mather
9,346,156 B1 5/2016 Fago
9,346,158 B2 5/2016 Garber et al.
9,399,281 B2 7/2016 Brendel et al.
9,459,075 B1 10/2016 Hatcher
9,469,021 B2 10/2016 Gregory et al.
9,486,904 B2 11/2016 Gregory et al.
9,498,871 B2 11/2016 Gregory et al.
9,527,196 B2 12/2016 Segura
9,577,493 B2 2/2017 Ekstrom et al.
9,643,200 B2 5/2017 Belanger
9,643,305 B2 5/2017 Gregory et al.
9,649,755 B2 5/2017 Gregory et al.
9,676,088 B2 6/2017 Leimbach et al.
9,744,657 B2 8/2017 Baron et al.
9,827,658 B2 11/2017 Gregory et al.
9,868,196 B2 1/2018 Chien
10,265,840 B2 4/2019 Anstett et al.
10,434,634 B2 10/2019 Garber
10,562,163 B2 2/2020 Akiba
10,604,172 B2 3/2020 Yoon et al.
10,661,470 B2 5/2020 Bauer et al.
2001/0038026 A1 11/2001 Dickhaut
2002/0104866 A1 8/2002 Miller et al.
2002/0117532 A1 8/2002 Miller et al.
2002/0174807 A1 11/2002 Mason
2002/0185514 A1 12/2002 Adams et al.
2003/0038786 A1 2/2003 Nguyen et al.
2003/0146262 A1 8/2003 Hwang et al.
2003/0230622 A1 12/2003 Rotharmel
2004/0169057 A1 9/2004 Ronconi
2004/0222266 A1 11/2004 Kakuda et al.
2005/0166713 A1 8/2005 Lloyd
2005/0217416 A1 10/2005 Berry et al.
2005/0220445 A1 10/2005 Baskar et al.
2005/0242152 A1 11/2005 Ronconi
2006/0102685 A1 5/2006 Phillips et al.
2006/0231582 A1 10/2006 Hong et al.
2006/0248998 A1 11/2006 Duginske
2006/0272269 A1 12/2006 Bannister
2006/0273131 A1 12/2006 Chen
2007/0045345 A1 3/2007 Monfeli et al.
2007/0090148 A1 4/2007 Cho et al.
2007/0102471 A1 * 5/2007 Gross ..... B25C 1/06 227/131
2007/0261868 A1 11/2007 Gross
2008/0054043 A1 3/2008 Beales
2008/0099525 A1 5/2008 Brendel et al.
2008/0135596 A1 6/2008 Wu et al.
2008/0223894 A1 9/2008 Cruise et al.
2008/0283568 A1 11/2008 Nayrac et al.
2008/0290128 A1 11/2008 Buetow
2008/0296340 A1 12/2008 Wang
2009/0050668 A1 2/2009 Jian
2009/0084824 A1 4/2009 Jiang
2009/0108046 A1 4/2009 Huang
2009/0120281 A1 5/2009 Yang
2009/0145520 A1 6/2009 Opsitos, Jr. et al.
2009/0152323 A1 6/2009 Lin
2009/0266867 A1 10/2009 Mina et al.
2010/0057014 A1 3/2010 Cane
2010/0116863 A1 5/2010 Suda
2010/0301091 A1 12/2010 Liang et al.
2010/0308098 A1 12/2010 Francis et al.
2011/0057014 A1 3/2011 Yang et al.
2011/0114692 A1 5/2011 Liang et al.
2011/0132959 A1 6/2011 Hlinka et al.
2011/0198381 A1 8/2011 McCardle et al.
2011/0215131 A1 9/2011 Liang
2011/0278342 A1 11/2011 Kuo
2011/0315414 A1 12/2011 Kuntner et al.
2011/0315840 A1 12/2011 Connolly et al.
2012/0074194 A1 3/2012 Miller et al.
2012/0187177 A1 7/2012 Myburgh et al.

(56) References Cited

U.S. PATENT DOCUMENTS

| | | | | |
|---|---|---|---|---|
| 2013/0029548 | A1 | 1/2013 | Stenzel et al. | |
| 2013/0032368 | A1 | 2/2013 | Zhang et al. | |
| 2013/0153254 | A1* | 6/2013 | Liang | B25D 11/00 173/114 |
| 2013/0227869 | A1 | 9/2013 | Thordsen | |
| 2013/0240299 | A1 | 9/2013 | Jagdale et al. | |
| 2013/0306699 | A1 | 11/2013 | Baskar et al. | |
| 2013/0320059 | A1 | 12/2013 | Gregory et al. | |
| 2013/0320060 | A1 | 12/2013 | Gregory et al. | |
| 2013/0320063 | A1 | 12/2013 | Gregory et al. | |
| 2013/0320064 | A1 | 12/2013 | Gregory et al. | |
| 2013/0320065 | A1 | 12/2013 | Gregory et al. | |
| 2013/0320066 | A1 | 12/2013 | Gregory et al. | |
| 2013/0320067 | A1 | 12/2013 | Gregory et al. | |
| 2013/0320068 | A1 | 12/2013 | Gregory et al. | |
| 2014/0069671 | A1 | 3/2014 | Leimbach et al. | |
| 2014/0076951 | A1* | 3/2014 | Brendel | B25C 1/06 227/8 |
| 2014/0076952 | A1* | 3/2014 | Garber | B25C 1/06 227/129 |
| 2014/0097223 | A1* | 4/2014 | Baron | B25C 5/15 227/131 |
| 2014/0158739 | A1 | 6/2014 | Grazioli et al. | |
| 2014/0325886 | A1 | 11/2014 | Mather | |
| 2014/0361066 | A1 | 12/2014 | Liu et al. | |
| 2014/0373329 | A1 | 12/2014 | Volfson | |
| 2015/0096776 | A1* | 4/2015 | Garber | B25C 1/00 173/1 |
| 2015/0122867 | A1 | 5/2015 | Segura | |
| 2015/0352702 | A1 | 12/2015 | Chien | |
| 2016/0129573 | A1 | 5/2016 | Anstett et al. | |
| 2017/0066116 | A1* | 3/2017 | Garber | B25C 1/06 |
| 2017/0232600 | A1 | 8/2017 | King, Jr. | |
| 2018/0001454 | A1 | 1/2018 | Jaskot et al. | |
| 2018/0001456 | A1 | 1/2018 | Garber | |
| 2018/0015600 | A1 | 1/2018 | Akiba | |
| 2018/0281840 | A1 | 10/2018 | Yoon et al. | |
| 2018/0333888 | A1 | 11/2018 | Bauer et al. | |
| 2019/0091844 | A1 | 3/2019 | Akiba | |
| 2019/0299380 | A1 | 10/2019 | Meyer et al. | |

FOREIGN PATENT DOCUMENTS

| | | | |
|---|---|---|---|
| EP | 931625 | A2 | 7/1999 |
| EP | 1206337 | A2 | 5/2002 |
| EP | 1207017 | A2 | 5/2002 |
| EP | 1795305 | A1 | 6/2007 |
| EP | 1798003 | A1 | 6/2007 |
| EP | 1864759 | A1 | 12/2007 |
| EP | 1884322 | A1 | 2/2008 |
| EP | 2065137 | A1 | 6/2009 |
| EP | 2105258 | A2 | 9/2009 |
| EP | 2105259 | A2 | 9/2009 |
| EP | 2301718 | A2 | 3/2011 |
| EP | 2441552 | A2 | 4/2012 |
| EP | 2687334 | A2 | 1/2014 |
| EP | 2711135 | A2 | 3/2014 |
| GB | 602455 | A | 5/1948 |
| JP | S5499276 | A | 8/1979 |
| JP | H06246649 | A | 9/1994 |
| JP | 2000354981 | A | 12/2000 |
| JP | 2002210676 | A | 7/2002 |
| WO | WO-2009046076 | A8 | 7/2010 |
| WO | WO-2015164032 | A1 | 10/2015 |

OTHER PUBLICATIONS

Office Action in corresponding European Patent Application No. 17737706.6 dated Feb. 13, 2020.
Hilti DX351—at least as early as Mar. 17, 2016.
Hilti DX460—at least as early as Mar. 17, 2016.
Hilti GX2—at least as early as Mar. 17, 2016.
Hilti GX120—at least as early as Mar. 17, 2016.
RAMSET Trackfast—at least as early as Mar. 17, 2016.
RAMSET XT540—at least as early as Mar. 17, 2016.
Simpson GCN—MEPMAG—at least as early as Mar. 17, 2016.
T3 RAMSET—at least as early as Mar. 17, 2016.
International Search Report and Written Opinion in International Patent Application No. PCT/US2017/039723 dated Sep. 6, 2017.
International Search Report and Written Opinion in corresponding International Patent Application No. PCT/US2017/039981 dated Oct. 12, 2017.
Extended European Search Report in European Patent Application No. 17178226.1 dated Nov. 20, 2017.
Extended European Search Report in European Patent Application No. 17177702.2 dated Jan. 4, 2018.
Extended European Search Report in European Patent Application No. 17177716.2 dated Mar. 28, 2018.
Extended European Search Report in European Patent Application No. 17178216.2 dated Mar. 29, 2018.
Extended European Search Report in European Patent Application No. 18158227.1 dated Dec. 3, 2018.
Extended European Search Report in European Patent Application No. 17821350.0 dated Jan. 28, 2020.
Office Action in European Patent Application No. 17737194.5 dated Feb. 13, 2020.

* cited by examiner

CORDLESS CONCRETE NAILER WITH IMPROVED POWER TAKE-OFF MECHANISM

CROSS-REFERENCE TO RELATED APPLICATIONS

This application claims the benefit of U.S. Provisional Application No. 62/356,966, filed on Jun. 30, 2016. This application also claims the benefit of U.S. Provisional Application No. 62/357,515, filed on Jul. 1, 2016. The entirety of each of the above applications is incorporated herein by reference.

FIELD

The present disclosure relates to power nailers and in particular to a cordless concrete nailer having an improved power take-off mechanism that increases the transfer of energy from the flywheel to the driver.

BACKGROUND

This section provides background information related to the present disclosure which is not necessarily prior art.

Fastening tools, such as power nailers have become relatively common place in the construction industry. While power nailers were initially predominantly pneumatic powered, cordless electric powered nailers have become increasingly popular due to the lack of hoses and the need for a source of pneumatic power. However, pneumatic powered nailers and power actuated nailers continue to predominate for those construction applications, such as steel framing and concrete construction, which employ fasteners requiring a high degree of power to install the fasteners. Hence, while cordless electric powered nailers have become very successful for use in conventional wood framing construction, power nailers of this type are presently not capable of reliably installing concrete fasteners, including the installation of hardened fasteners through steel framing into concrete; particularly for use in commercial construction applications.

For example, commonly assigned U.S. Pat. No. 9,399,281, filed Mar. 12, 2013 and issued Jul. 26, 2016 discloses a power take-off (PTO) assembly of a cordless electric powered nailer including a carrier pivotably supporting a pinch roller. A pair of torsion springs (identified in the patent by reference number 3060) operate to position the carrier in an initial angular or pivotable orientation. This avoids the carrier being in an improper orientation upon activation that results in the tool misfiring. A rotational or pivot force is imparted to the carrier that has a magnitude that is related to a magnitude of the pinch force on the driver. Because these magnitudes are relatively small in conventional wood framing construction, the torsion springs are typically capable of surviving being repeatedly subjected to such forces throughout the life of the tool. Such torsional springs, however, have not been found to provide similar survivability in the context of the forces involved in a concrete fastener installation tool or driver; particularly in a commercial construction context.

SUMMARY

This section provides a general summary of the disclosure, and is not a comprehensive disclosure of its full scope or all of its features. In addition, any feature or combination of features included in this general summary are not necessarily critical or particularly important to the disclosure.

In accordance with one aspect of the disclosure, a cordless electric nailer includes a power take-off (PTO) assembly positioned to selectively engage a nail driver against a flywheel. The PTO includes a bracket supporting a solenoid and a compression spring and a linkage arm coupled between a plunger of the solenoid and the compression spring. The linkage arm is biased by the compression spring toward the nail driver. A carrier supports or carries a pinch roller and the carrier is pivotably mounted to the bracket via a pivot pin. An engaging surface is movable with the plunger between an engagement position in which the engaging surface engages a cooperating engaging surface of the carrier and orients the carrier into a corresponding engagement orientation, and a disengagement position in which the engaging surface is spaced away from the cooperating engaging surface of the carrier, allowing the carrier to pivot outside the corresponding engagement orientation.

In accordance with another aspect of the disclosure, a cordless electric concrete nailer includes a power take-off (PTO) assembly positioned to selectively engage a concrete nail driver against a flywheel. The PTO includes a bracket supporting a solenoid and a compression spring and a linkage arm coupled between a plunger of the solenoid and the compression spring. The linkage arm is biased by the compression spring toward the concrete nail driver. A carrier supports or carries a pinch roller and the carrier is pivotably mounted to the bracket via a pivot pin. An engaging surface is movable with the plunger between an engagement position in which the engaging surface engages a cooperating engaging surface of the carrier and orients the carrier into a corresponding engagement orientation, and a disengagement position in which the engaging surface is spaced away from the cooperating engaging surface of the carrier, allowing the carrier to pivot outside the corresponding engagement orientation. The spring of the concrete nailer provides a biasing force on the linkage arm that generates a compressive force of at least about 500 pounds per square inch on the concrete nail driver through the pinch roller.

Further areas of applicability will become apparent from the description provided herein. It should be understood that the description and specific examples in this summary are intended for purposes of illustration only and are not intended to limit the scope of the present disclosure, its application and/or uses in any way.

BRIEF DESCRIPTION OF THE DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION OF THE PREFERRED EMBODIMENTS

Figure 1:
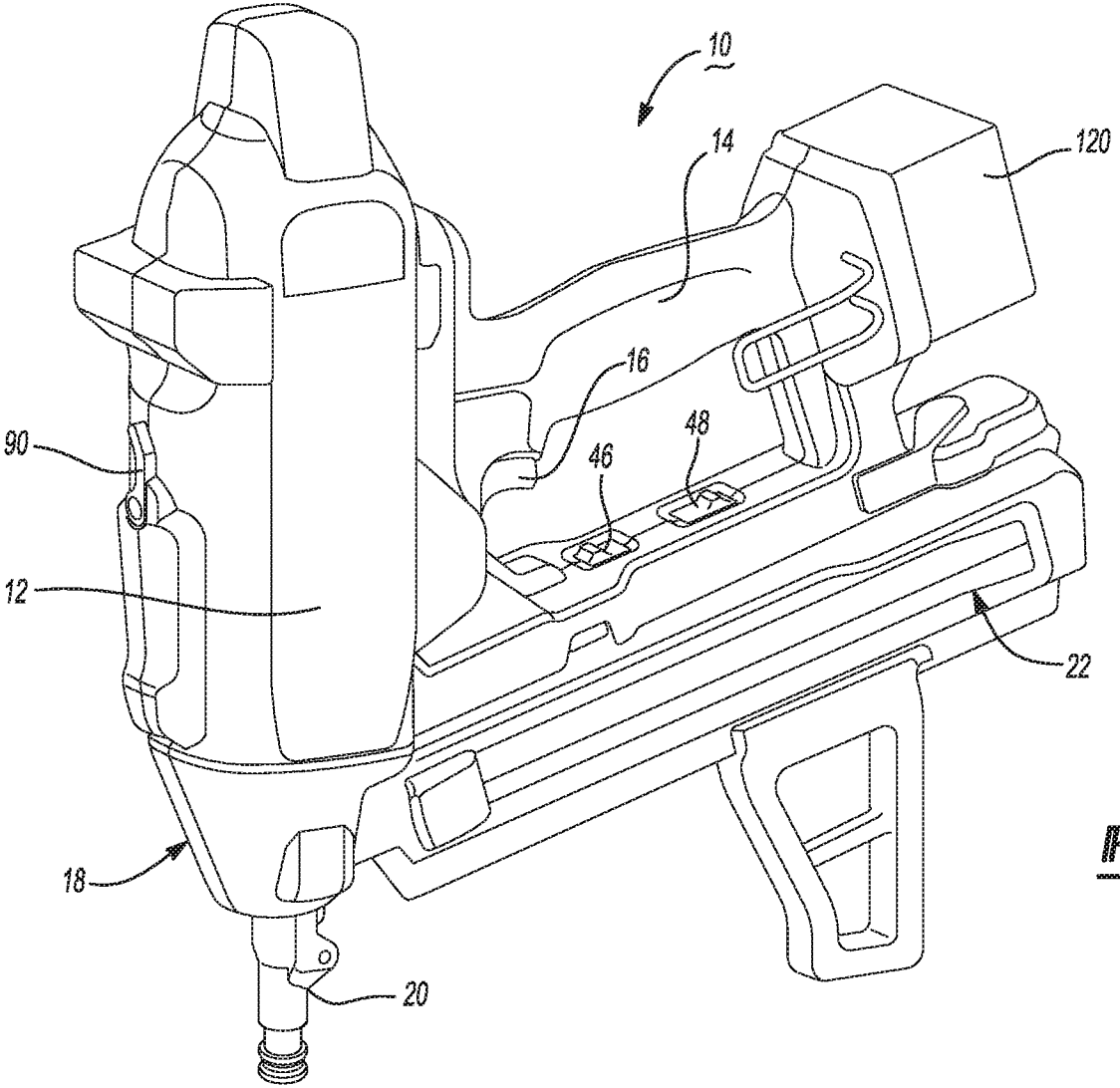
FIG. 1 is a perspective view of an exemplary nailer constructed in accordance with the teachings of the present disclosure.

With reference to FIG. 1, a cordless concrete nailer in accordance with the teachings of the present disclosure is shown and generally indicated by reference numeral 10. The nailer 10 includes a housing 12 having a handle portion 14 containing a trigger switch 16. Connected to the lower end of the housing 12 is a nosepiece assembly 18 having a contact trip mechanism 20 projecting therefrom. Also coupled to the nosepiece assembly 18 and oriented substantially parallel to the handle 14 of the housing 12 is a magazine assembly 22 which is configured to hold a plurality of fasteners and sequentially dispense the fasteners into the nosepiece assembly 18. The details of the magazine assembly are conventional and will not be discussed in further detail.

Preferably, a battery pack 120 is removably coupled to the base of the handle portion 14 of the housing 12. The battery pack 120 may comprise a 24 volt lithium-ion based power cell which is capable of supplying the power required to properly install an appropriate number of hardened steel nails through steel framing into concrete on a single full charge.

Figure 2:
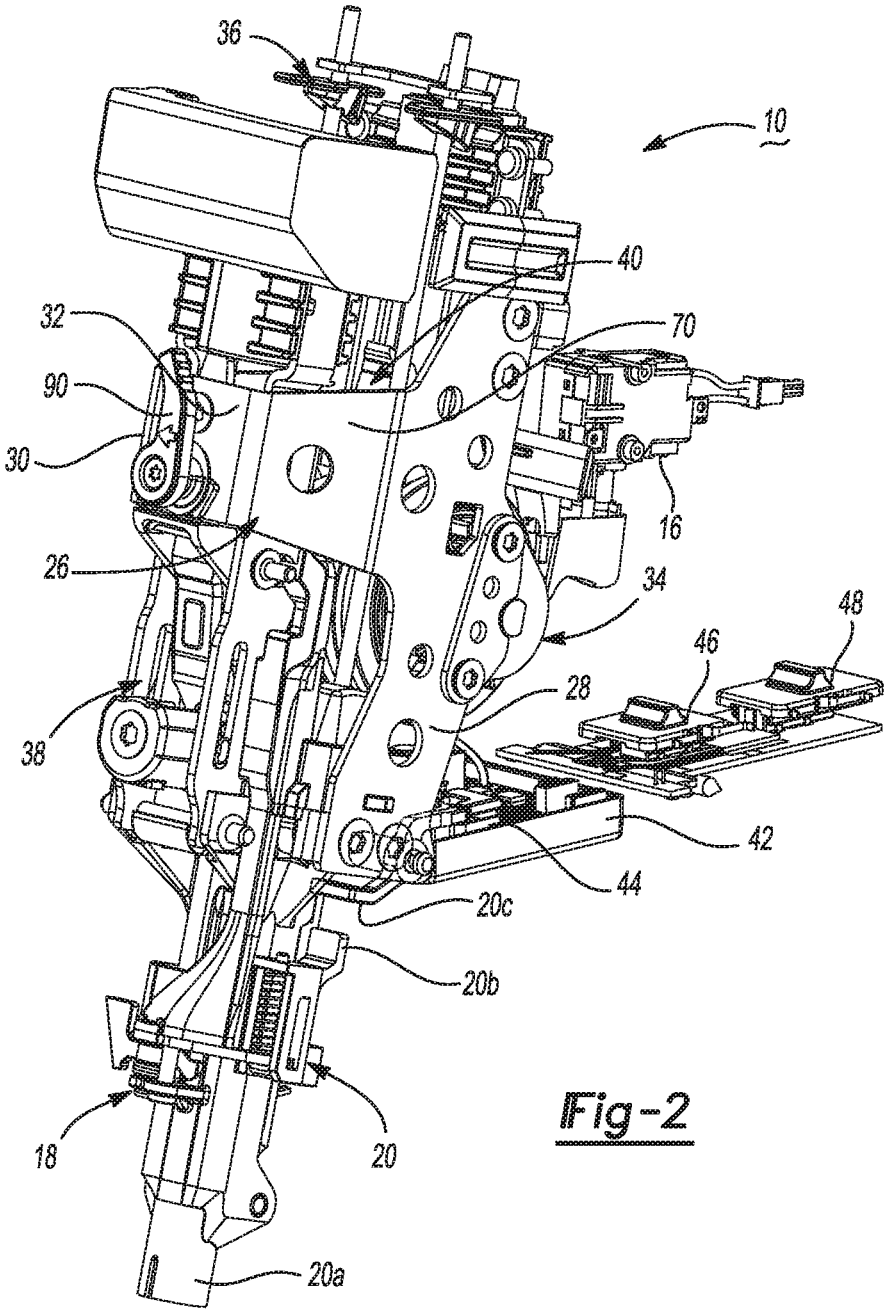
FIG. 2 is a perspective view of a portion of the nailer of FIG. 1.

Referring to FIG. 2, a perspective view of a portion of the present cordless concrete nailer 10 is shown with the outer housing removed. The cordless concrete nailer 10 includes a frame or backbone member 26 having first and second, spaced-apart, generally parallel arm segments 28, 30 that are integrally joined to a generally U-shaped central bridge segment 32. The frame member 26 is preferably made from high strength stamped steel. Mounted to the frame member 26 between the arm segments 28, 30 of the frame are the motor/flywheel assembly 34, the driver assembly 36, the power take-off assembly 38 and a driver retraction assembly 40. Also mounted to the lower end of the frame 26 are the nosepiece assembly 18 and an electronic control module 42 containing a microcontroller-based control circuit 100 for controlling the operation of the tool.

Figure 5:
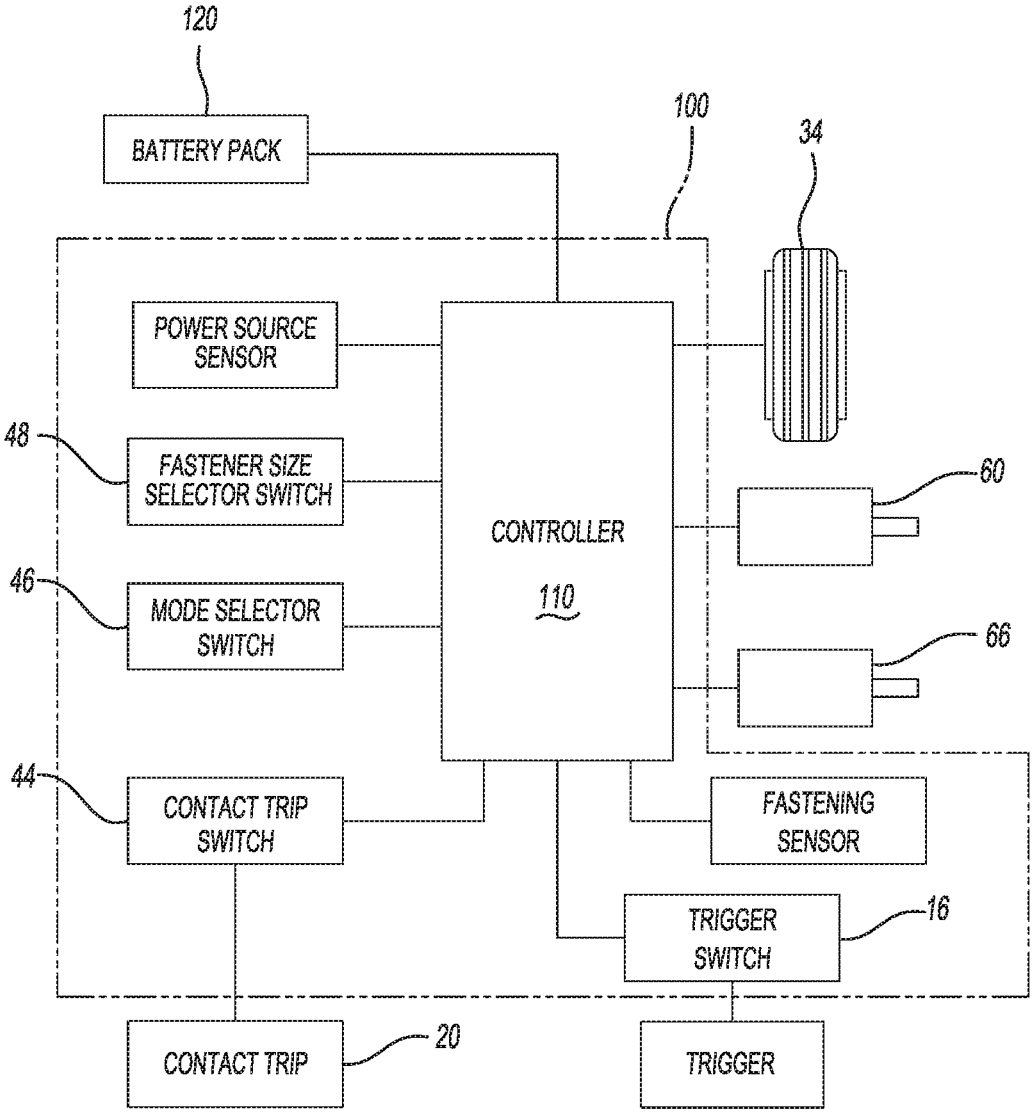
FIG. 5 is a block diagram of the control circuit for the nailer.

With additional reference to FIG. 5, the control circuit 100 includes a microcontroller 110 that is electrically connected to receive input signals from a plurality of switches/sensors, including the trigger switch 16, a contact trip switch 44, a mode selector switch 46 and a fastener size selector switch 48. The trigger switch 16 is an ON/OFF switch that controls the application of power from the battery pack 120 to the control circuit 100, which in turn controls the application of power to the motor/flywheel assembly 34.

The nosepiece assembly 18 as noted includes a contact trip mechanism 20 that extends from the nosepiece assembly 18 and prevents the tool from inadvertently firing a fastener. In particular, the contact trip mechanism 20 includes a tubular extension **20*a* which, when pressed against a workpiece, retracts into the nosepiece assembly 18. Retraction of tubular extension 20*a* causes a corresponding upward movement of the spring-loaded contact trip mechanism 20 until a tab 20*b* on the mechanism actuates a pivotable lever 20*c* which in turn closes the contact trip switch 44 mounted on the control module 42. The controller 100 is programmed to prevent the firing of the tool if the contact trip switch 44** is not closed.

In the preferred embodiment, the mode selector switch 46 is a 2-position switch that enables the user to select between two operating modes. One mode of operation may be, for example, a sequential fire mode wherein the contact trip 20 must first be abutted against a workpiece (so that the contact trip switch 44 is closed) and thereafter the trigger switch 16 is actuated to generate a firing signal. Another mode of operation may be a mandatory bump feed mode wherein the trigger switch 16 is first actuated to generate a trigger signal and thereafter the contact trip extension **20*a* is abutted against a workpiece so that the contact trip switch 44** is closed to generate the firing signal.

The fastener size selector switch 48 in the preferred embodiment may also be a 2-position selector switch, which in a first position sets the drive force of the tool to a first output level appropriate for installing fasteners of a first size, and in a second position sets the drive force of the tool at a second output level greater than the first output level appropriate for installing fasteners of a second size larger than the first size. In the preferred embodiment, the drive force output level of the tool is controlled by the control circuit 100 by adjusting the target rotational speed of the flywheel 52. A control algorithm for controlling the speed of the flywheel is described in greater detail in U.S. Pat. No. 8,534,527, also assigned to the assignee of the present application, which disclosure is incorporated herein by reference.

Additionally, the controller 110 is further programmed to generate output signals that control the activation of a pair of solenoids. A first solenoid 60 is part of the power take-off assembly 38 described in greater detail below, which controls the initiation of the drive stroke, and hence, the firing of the tool. The second solenoid 66 is part of the driver retraction assembly 40 which serves to retract the driver and return it to its original starting position following the completion of a drive stroke. The detailed operation of the control circuit 100 as it pertains to particular features of the present disclosure will be described in greater detail below.

Figure 3:
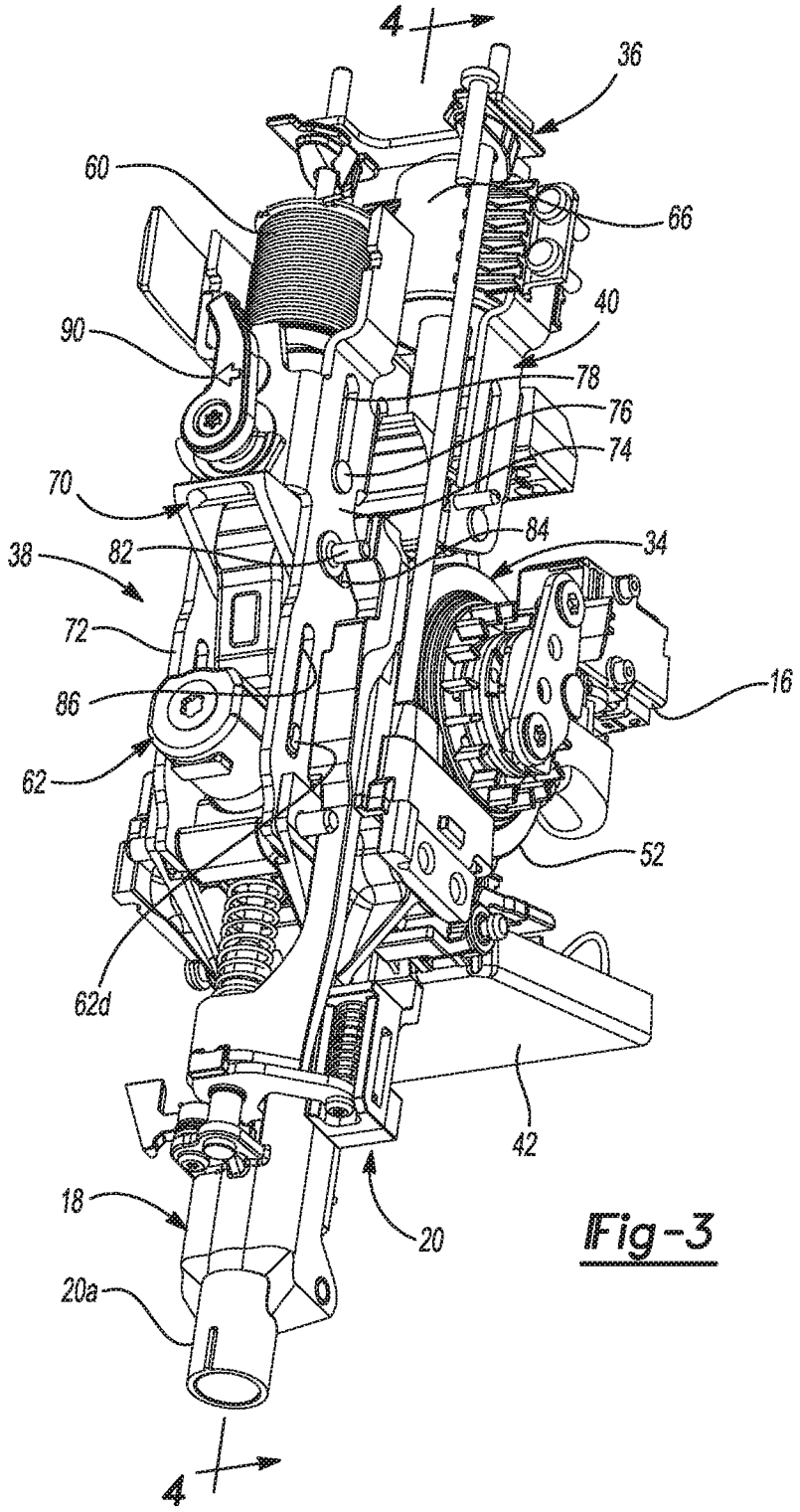
FIG. 3 is a perspective view of a portion of the nailer of FIG. 1, illustrating a drive motor assembly in more detail.
Figure 4:
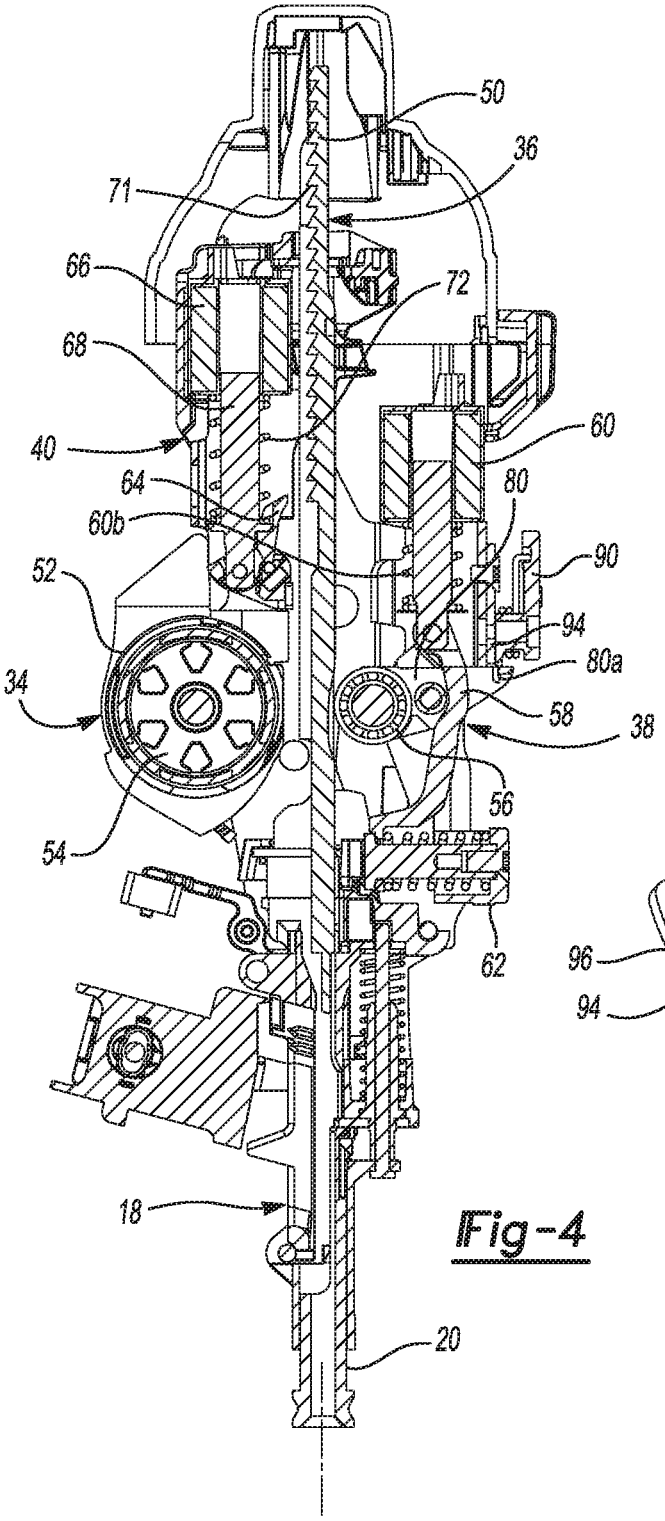
FIG. 4 is a sectional view of the portion of the nailer shown in FIG. 3, taken along line 4-4.

Turning to FIGS. 3 and 4, a portion of the present cordless concrete nailer 10 is shown with the frame member removed. The driver system 36 is located along the central axis of the tool and includes a driver 50 that is supported for oscillatory movement along said axis. In particular, the driver 50 is arranged to move rapidly in the downward direction, as depicted in the drawings, during the drive stroke, and to be retracted upward to its original position during the return stroke.

The driver 50 is driven by a flywheel 52, which in the preferred embodiment comprises the rotor of an outer rotor motor 54. The construction of a motor/flywheel assembly 34 of this type is described in greater detail in pending application Ser. No. 13/840,015, filed Mar. 15, 2013 and assigned to the assignee of the present application, which disclosure is incorporated herein by reference. The motor assembly 34 including the rotating outer flywheel 52 is mounted on one side of the driver 50, as shown in FIG. 4.

The driver 50 is selectively drivingly engaged with the flywheel 52 via operation of a power take-off ("PTO") assembly 38 located on the opposite side of the driver 50, relative to the motor assembly 34. When actuated, the PTO assembly 38 is configured to move the driver 50 laterally relative to the axis of the tool 10, to thereby selectively engage, press or squeeze the driver 50 against the outer circumference of the flywheel 52. In general, the PTO assembly 38 includes a pinch roller 56, a linkage member or arm 58, a solenoid 60 and a compression spring assembly 62. Actuation of the PTO assembly 38 is achieved by energizing the solenoid 60 via a control signal from the control circuit 100. When energized, the solenoid 60 retracts the linkage arm 58, causing the pinch roller 56 to move laterally and engage the driver 50. The compression spring assembly 62 serves to apply a predetermined compression force on the pinch roller to insure that the driver 50 is tightly "pinched" against the outer circumferential surface of the flywheel 52. This action facilitates the efficient transfer of stored energy from the rotating flywheel 52 to the driver 50.

Also located on the motor assembly 34 side of the driver 50 is the driver retraction assembly 40. The driver retraction assembly 40 is configured to retract or return the driver 50 to its original "home" position, as illustrated in FIG. 4, following the execution of a drive stroke. In general, the driver retraction assembly 40 includes a pivoting latch member 64 that is coupled to and operated by a second solenoid 66. More specifically, when the solenoid 66 is energized by a control signal from the control circuit 100, the solenoid plunger 68 is retracted, thereby causing the latch member 64 to pivot clockwise and engage the ratchet teeth 71 formed on the confronting side of the driver 50. As the solenoid plunger 68 continues to retract, the driver 50 is incrementally raised or retracted a predetermined distance. When the solenoid 66 is de-energized, a return spring 72 causes the solenoid plunger 68 to return to its original extended position, as shown in FIG. 4, which similarly causes the latch member 64 to pivot counterclockwise and disengage from the driver 50. This cycle is repeated a predetermined number of times (e.g., 5) under the control of the control circuit 100, to insure that the driver 50 is fully retracted into its original home position before a succeeding drive stroke is initiated.

Turning now to FIGS. 6A-6D, a detailed description of the construction and operation of the PTO assembly 38 will now be explained.

The power take-off ("PTO") assembly 38, when activated, presses or pinches the driver 50 into engagement with the outer circumferential surface of the flywheel 52, thereby transferring the rotational energy stored in the flywheel 52 to the driver 50. With additional reference to FIG. 3, the PTO assembly 38 includes a longitudinal U-shaped bracket 70 having complimentary parallel arms 72, 74 supporting a solenoid 60 at one end and a compression spring assembly 62 at the opposite end. The plunger 60*a* of the solenoid 60 is connected via a first pin or coupling 76 to a first, or rearward end of a complimentary pair of arms of the linkage arm 58. The other or forward end of the linkage member 58 is connected to the compression spring assembly 62 and is biased by the compression spring 62*a* toward the nail driver 50. Thus, the linkage arm 58 is coupled between the plunger 60*a* of the solenoid 60 and the compression spring 62*a*. The coupling 76 couples plunger 60*a* directly to the linkage arm 58. Alternatively, the coupling can be an assembly, including an extending arm that is coupled at one end to the plunger 60*a* and at an opposite end to the linkage arm 58, thereby indirectly coupling the plunger 60*a* and the arm 58 together. In the illustrated example, the linkage arm 58 extends fully between the plunger 60*a* and the compression spring 62*a* of the spring assembly 62. The first coupling 76 that couples the solenoid plunger 60*a* to the linkage arm 58 also rides within a first longitudinal slot 78 formed in the arms of the bracket 70.

The pinch roller 56 is journaled to a cam member or carrier 80 that is pivotably supported between the bracket arms 72, 74 by a second pin 82 which rides within a second vertically oriented slot 84 formed in the bracket arms 72, 74. The second pin 82 also serves as a cam follower and engages an inclined cam surface 58*a* formed on the underside of the linkage arm 58.

The compression spring assembly 62 comprises a high compression force spring 62*a* that is mounted within a cage 62*b* containing a vertically oriented post 62*c* supporting the spring 62*a*. The compression spring 62*a* is contained between the top of the cage 62*b* at its upper end and the forward end 58*b* of the linkage arm 58 at its lower end. The cage 62*b* of the compression spring assembly 62 is provided with a third flat-sided pin 62*d* that rides within a third horizontally disposed slot 86 formed in the arms 72, 74 of the bracket 70. Thus, the compression spring assembly 62 is able to move horizontally fore and aft with the movement of the solenoid plunger 60*a*.

Figure 6A:
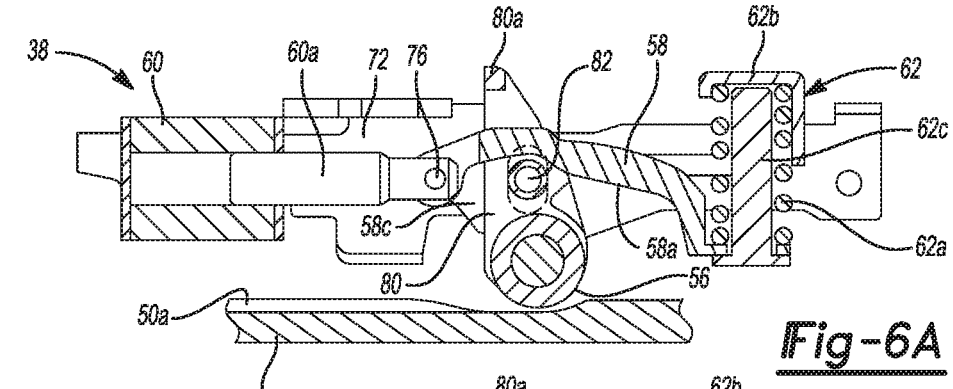
FIGS. 6A-6D are detailed sectional views of the power take-off assembly of the nailer.

With particular reference to FIGS. 6A-6D, the PTO assembly operates in the following manner. Before the onset of the drive stroke, the plunger 60*a* of the solenoid 60 is fully extended, and the carrier 80 and pinch roller 56 are in their uppermost position. In addition, the linkage arm 58 and compression spring assembly 62 are in the positions shown in FIG. 6A. With the PTO assembly 38 in this condition, the driver 50 is disengaged from the flywheel 52. In the positions of FIG. 6A, the linkage arm 58 includes or carries a protrusion 58*c* that has a front or forward facing edge or surface 58*d* engaging against a rear or rearward facing edge or surface 80*d* of the carrier 80 to orient the carrier 80 in an corresponding engagement orientation or position.

In the illustrated example, the corresponding engagement orientation of the carrier 80 is at or near an overcenter orientation or position. In such an overcenter orientation or position, the axis of cam follower or pivot pin 82 extending through the carrier 80 is in a leftward or rearward position relative to the axis of pinch roller 56 carried by the carrier 80. Without insuring an appropriate initial orientation or position of the carrier 80, the carrier 80 might be oriented in an improper position, such as that illustrated in FIG. 6D, causing the tool to misfire when activated. In this example, the corresponding engagement orientation of the carrier 80 is limited to a single rotational or angular orientation of the carrier 80. Also in this example, engagement surface 58*d* and the cooperating engagement surface 80*d* each comprise a linear surface, and these linear surfaces 58*d*, 80*d* are in face-to-face contact in the engagement position. In other examples, the corresponding engagement orientation of the carrier 80 can include a range of acceptable orientations.

Figure 6B:
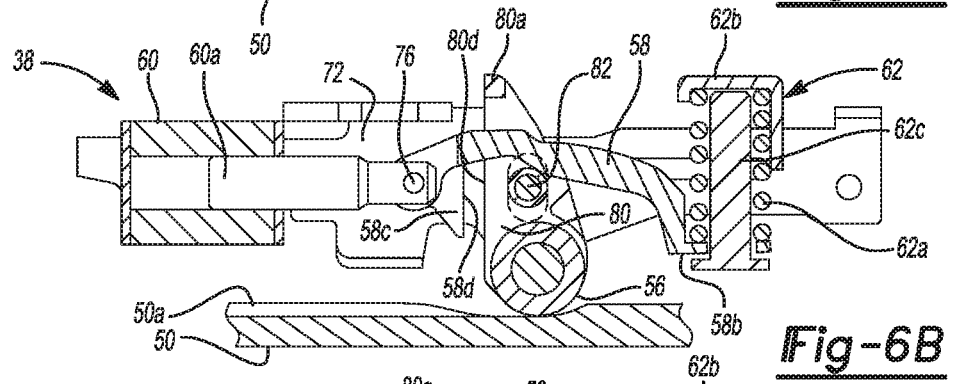
Figure 6C:
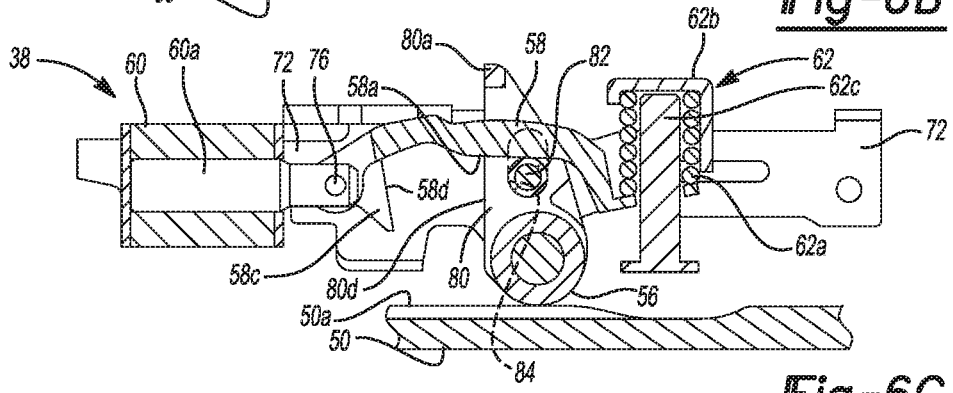
Figure 6D:
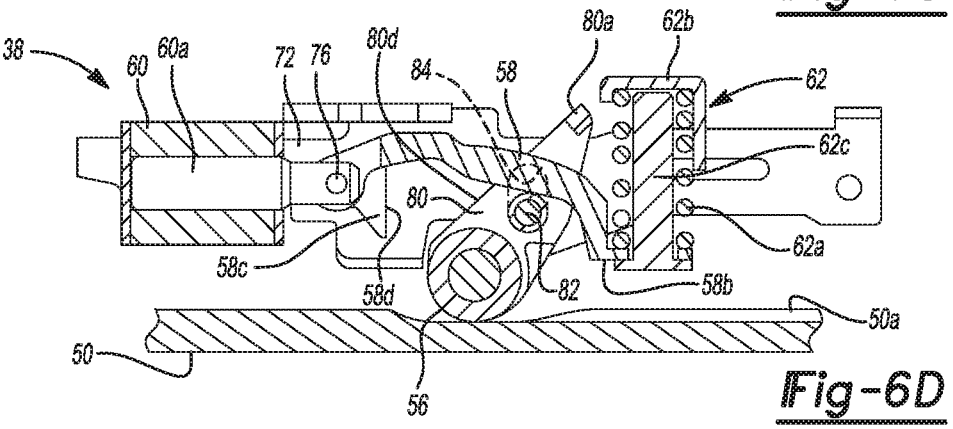

To initiate the drive stroke, the PTO solenoid 60 is energized and the plunger 60*a* of the solenoid is retracted, thereby pulling the linkage arm 58 from right (forward) to left (rearward) as shown in the drawings. Referring to FIG. 6B, as the plunger 60*a* and the linkage arm 58 begins moving to the left, the protrusion 58*c* and its engaging surface 58*d* moves rearward away from the cooperating engaging surface 80*d* of the carrier 80 while the carrier 80 is forced downward at or near its corresponding engagement orientation by the interaction between the second cam follower pin 82 and the inclined cam surface 58*a* on the underside of the arms of the linkage member 58. This vertical movement of the carrier 80 causes the properly oriented pinch roller 56 to press the driver 50 into engagement with the outer circumferential surface of the flywheel 52, thereby initiating the drive stroke of the driver 50, as shown in FIG. 6B. Once the drive stroke is initiated, the pinch roller 56 "rides up" onto the raised drive surface 50*a* formed on the opposing surface of the driver 50, thereby causing the forward end 58*b* of the linkage arm 58 to compress the compression spring 62*a*. Hence, with the solenoid 60 in its fully retracted position illustrated in FIG. 6C and the compression spring 62*a* compressed, the pinch roller 56 exerts a compression force of preferably at least about 500 pounds per square inch (or about 345 Newtons per square centimeter) against the driver 50 and, between the driver 50 and the flywheel 52, insuring the efficient transfer of energy from the flywheel 52 to the driver 50. The release of the compressive force at the end of the driver 50 stroke imparts a pivot force on the carrier 80 that has a magnitude that is related to a magnitude of the compressive force. As illustrated in FIG. 6D, the engaging surface 58*d* is in the disengagement position when the compressive force is released.

The engaging surface 58*d* is movable with the plunger 60*a* from its an engagement position in which the engaging surface 58*d* engages the cooperating engaging surface 80*d* of the carrier 80 and orients the carrier 80 into the corresponding engagement orientation (FIG. 6A). As seen in FIG. 6A, the engagement position corresponds to an extended position of the plunger 60*a*. The engaging surface 58*d* is also movable with the plunger 60*a* into a disengagement position in which the engaging surface 80*d* is spaced away from the cooperating engaging surface 80*d* of the carrier 80 allowing the carrier 80 to pivot outside the corresponding engagement orientation (FIGS. 6B-6D). As seen in FIGS. 6B-6D, the disengagement position corresponds to a retracted position of the plunger 60*a*. In the illustrated example, the engagement surface is positioned adjacent the coupling 76 between the plunger 60*a* and the linkage arm 58.

At the end of the drive stroke, the end of the raised drive surface 50*a* on the driver 50 passes the pinch roller 56, as shown in FIG. 6D. As the pinch roller 56 rides down the trailing end of the raised drive surface 50*a*, the angle of the trailing end causes the carrier 80 to pivot clockwise and release the overcenter configuration of the carrier 80 (i.e., the axis of cam follower pin 82 is in a rightward or forward position relative to the axis of pinch roller 56), as shown in FIG. 6D, and thereby releases the compression force on the pinch roller 56 applied by the compression spring 62*a*. The carrier 80 is able to move into this release or reverse overcenter configuration, position, or orientation because the solenoid 60 has moved the engaging surface 58*d* of the protrusion 58*c* sufficiently rearward, or away from the cooperating engaging surface 80*d* of the carrier 80. With the PTO assembly 38 in this position, the driver 50 is effectively disengaged from the flywheel 52.

After a predetermined time period sufficient to insure completion of the drive stroke, the power to the solenoid 60 is interrupted. Once the solenoid 60 is de-energized, a return spring 60*b* (FIG. 4) on the solenoid 60 drives the plunger 60*a* outward (i.e., to the right in FIGS. 6A-6D) into its original position, returning the linkage arm 58 to its original position. As the linkage arm 58 returns to its original or initial position (FIG. 6A), the engaging surface 58*d* of the protrusion 58*c* moves back forward toward and into engagement with the cooperating engaging surface 80*d* of the carrier 80, causing the carrier 80 to also rotate or pivot counterclockwise into its initial position shown in FIG. 6A. Thus, with the PTO assembly 38 returned to its fully disengaged position, the driver 50 is free to be retracted by the return mechanism 40 into its "home" position in preparation for the next firing stroke.

On occasion, due to various external factors such as obstructions in the workpiece, a fastener may fail to become fully installed in the workpiece, and thereby prevent the driver 50 from completing the drive stroke. In such an event, the driver stroke may be interrupted with the carrier 80 in its overcenter configuration while the pinch roller 56 is still engaged with the raised drive surface 50*a* and the driver 50. Under such circumstances, the driver 50 may become "jammed" with the retraction mechanism 40 unable to retract the driver 50 despite the PTO solenoid 60 being de-energized.

Figure 7:
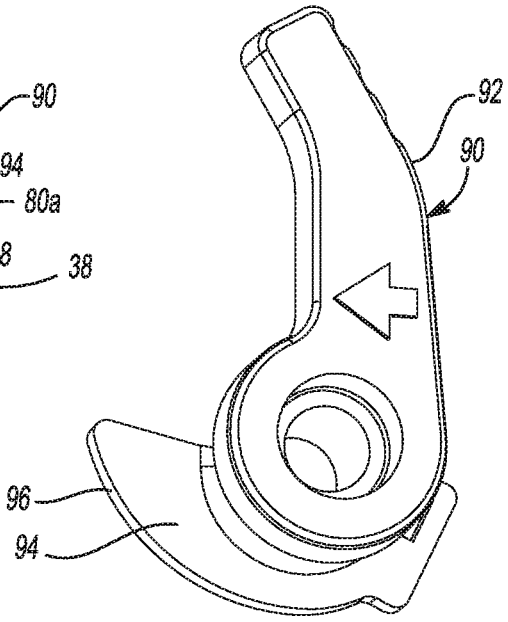
FIG. 7 is a perspective view of the release lever for the power take-off assembly.

To address this contingency and completely release the pressure applied by the PTO assembly 38 on the driver 50, the PTO assembly 38 is further provided with a release lever 90 that is rotatably mounted to the top of the U-shaped bracket 70. With reference to FIG. 7, the release lever 90 comprises a lever arm 92 and an arcuate cam portion 94 having an eccentric outer cam surface 96. When installed on the U-shaped bracket 70, the lever portion 92 of the release lever 90 is exposed on the outer surface of the housing 12 (FIG. 1), and the cam portion 94 of the release lever 90 is positioned adjacent to a raised tab 80*a* formed on the carrier 80, as best shown in FIG. 4. When the release lever 90 is rotated, the eccentric outer cam surface 96 of the cam portion 94 acts on the raised tab 80*a* causing the carrier 80 to rotate clockwise from the overcenter configuration or position shown in FIG. 6C to the released or reverse-overcenter configuration or position shown in FIG. 6D. With the carrier 80 in the position shown in FIG. 6D, the pressure applied by the pinch roller 56 on the driver 50 is relieved, thereby freeing the driver 50 and enabling the retraction mechanism 40 to retract the driver 50 to its initial home position. A similar stall release lever is disclosed in commonly assigned U.S. Pat. No. 9,399,281, filed Mar. 12, 2013 and issued Jul. 26, 2016, the entirety of which is incorporated herein by reference.

The foregoing description of an example embodiment has been provided for purposes of illustration and description. It is not intended to be exhaustive or to limit the disclosure. Individual elements or features of a particular embodiment are generally not limited to that particular embodiment, but, where applicable, are interchangeable and can be used in a different embodiment, even if not specifically shown or described. The same may also be varied in many ways. Such variations are not to be regarded as a departure from the disclosure, and all such modifications are intended to be included within the scope of the disclosure.

What is claimed is:

1. A cordless electric nailer comprising:

a power take-off (PTO) assembly positioned to selectively engage a nail driver against a battery-powered electric motor driven flywheel, the PTO assembly including:

a bracket supporting a solenoid and a compression spring;

a linkage arm coupled between a plunger of the solenoid and the compression spring, and the linkage arm being biased by the compression spring toward the nail driver;

a carrier supporting a pinch roller and the carrier being pivotably mounted to the bracket via a pivot pin;

an engaging surface movable with the plunger between an engagement position in which the engaging surface engages against a cooperating engaging surface of the carrier to orient the carrier into a corresponding engagement orientation when the solenoid is de-energized, and a disengagement position in which the engaging surface is spaced away from the cooperating engaging surface of the carrier to allow the carrier to pivot outside the corresponding engagement orientation when the solenoid is energized.

2. The cordless electric nailer of claim 1, wherein the corresponding engagement orientation is limited to a single orientation of the carrier.

3. The cordless electric nailer of claim 2, wherein the engaging surface and the cooperating engaging surface each comprise a linear surface, and the linear surfaces are in face-to-face contact in the engagement position.

4. The cordless electric nailer of claim 1, wherein the corresponding engagement orientation includes an orientation of the carrier in which the carrier is in or adjacent an overcenter position with respect to an axis of the pivot pin and an axis of the pinch roller.

5. The cordless electric nailer of claim 1, wherein the engaging surface is positioned adjacent a coupling that joins the plunger and the linkage arm together.

6. The cordless electric nailer of claim 5, wherein the coupling directly couples the plunger to the linkage arm.

7. The cordless electric nailer of claim 1, wherein a surface of a protrusion comprises the engaging surface.

8. The cordless electric nailer of claim 1, wherein a surface of the linkage arm comprises the engaging surface.

9. The cordless electric nailer of claim 1, wherein a surface of a protrusion of the linkage arm comprises the engaging surface.

10. The cordless electric nailer of claim 1, wherein the engagement position corresponds to an extended position of the plunger.

11. The cordless electric nailer of claim 1, wherein the disengagement position corresponds to a retracted position of the plunger.

12. The cordless electric nailer of claim 1, wherein the cordless electric nailer is a concrete nailer.

13. The cordless electric nailer of claim 12, wherein the compression spring of the concrete nailer provides a biasing force on the linkage arm that generates a compressive force on the nail driver through the pinch roller, and release of the compressive force imparts a pivot force on the carrier having a magnitude that is related to a magnitude of the compressive force.

14. The cordless electric nailer of claim 13, wherein the engaging surface is in the disengagement position when the compressive force is released.

15. The cordless electric nailer of claim 13, wherein a magnitude of the compressive force is at least 500 pounds per square inch.

16. The cordless electric nailer of claim 1, wherein the linkage arm extends fully between the plunger and the compression spring.

17. The cordless electric nailer of claim 1, wherein the pivot pin is a cam follower pin and is supported in slots of the bracket, and the linkage arm comprises a cam surface that the cam follower pin follows.

18. A cordless electric concrete nailer comprising:

a power take-off (PTO) assembly positioned to selectively engage a concrete nail driver against a battery-powered electric motor driven flywheel, the PTO assembly, including:

a bracket supporting a solenoid and a compression spring;

a linkage arm coupled between a plunger of the solenoid and the compression spring, and the linkage arm being biased by the compression spring toward the concrete nail driver;

a carrier supporting a pinch roller and the carrier being pivotably mounted to the bracket via a pivot pin;

an engaging surface movable with the plunger between an engagement position in which the engaging surface engages against a cooperating engaging surface of the carrier to orient the carrier into a corresponding engagement orientation when the solenoid is de-energized, and a disengagement position in which the engaging surface is spaced away from the cooperating engaging surface of the carrier to allow the carrier to pivot outside the corresponding engagement orientation when the solenoid is energized, wherein the compression spring of the concrete nailer provides a biasing force on the linkage arm that generates a compressive force of at least 500 pounds per square inch on the concrete nail driver through the pinch roller.

19. The cordless electric concrete nailer of claim 18, wherein a surface of the linkage arm comprises the engaging surface.

20. The cordless electric nailer of claim 19, wherein a surface of a protrusion of the linkage arm comprises the engaging surface.

* * * * *